US007108059B1

(12) United States Patent
Lanier

(10) Patent No.: US 7,108,059 B1
(45) Date of Patent: Sep. 19, 2006

(54) DOWNHOLE PUMP

(76) Inventor: Bruce Lanier, 1706 S. 17th St., Artesia, NM (US) 88210

( * ) Notice: Subject to any disclaimer, the term of this patent is extended or adjusted under 35 U.S.C. 154(b) by 32 days.

(21) Appl. No.: 10/705,138

(22) Filed: Nov. 10, 2003

(51) Int. Cl.
*E21B 43/12* (2006.01)

(52) U.S. Cl. ..... 166/105; 166/112

(58) Field of Classification Search ..... 166/105, 166/105.5, 105.6, 107, 112, 154, 68
See application file for complete search history.

(56) References Cited

U.S. PATENT DOCUMENTS

| | | | | |
|---|---|---|---|---|
| 2,518,275 | A | 8/1950 | Bowerman | |
| 3,139,039 | A | 6/1964 | Adams | |
| 3,724,337 | A | 4/1973 | Richardson | |
| 3,861,471 | A * | 1/1975 | Douglas | 166/369 |
| 4,087,212 | A | 5/1978 | Holder | |
| 4,219,311 | A * | 8/1980 | Simon | 417/260 |
| 4,221,551 | A * | 9/1980 | Rupert | 417/511 |
| 4,599,054 | A | 7/1986 | Spears | |
| 4,867,242 | A * | 9/1989 | Hart | 166/369 |
| RE33,163 | E | 2/1990 | Madden | |
| 5,372,488 | A | 12/1994 | Turner | |
| 6,273,690 | B1 | 8/2001 | Fischer, Jr. et al. | |
| 6,585,049 | B1 * | 7/2003 | Leniek, Sr. | 166/369 |
| 6,684,946 | B1 * | 2/2004 | Gay et al. | 166/105 |
| 2002/0076343 | A1 | 6/2002 | Spears | |

* cited by examiner

*Primary Examiner*—Frank S. Tsay
(74) *Attorney, Agent, or Firm*—Dunlap, Codding & Rogers, P.C.

(57) ABSTRACT

The present invention is directed to a downhole pump assembly having a housing, a standing valve located near the lower end of the housing, a plunger disposed in the chamber of the housing below the upper and lower internal shoulders thereof and adapted for reciprocating movement through at least a portion of the chamber of the housing, and a traveling valve located in the plunger. A pull rod has one end connected to the plunger and an opposite end connected to a sucker rod string to affect reciprocating movement of the plunger. A sliding valve is positioned in a chamber of the housing between an upper internal shoulder and an internal shoulder. The sliding valve moves in an upward direction upon upward movement of the plunger so that fluid passes around the sliding valve, and the sliding valve moves in a downward direction upon downward movement of the plunger to restrict the downward flow of fluid through the chamber of the housing so that the pressure above the traveling valve is less than the pressure below the traveling valve to cause the traveling valve to open. The pull rod is provided with a plurality of vertical grooves so that the vertical grooves extend through the sliding valve near the end of the downward movement of the plunger to cause the pressure above the sliding valve and the pressure below the sliding valve to be substantially equalized so that the sliding valve is caused to move in the upward direction upon upward movement of the plunger.

12 Claims, 3 Drawing Sheets

DOWNHOLE PUMP

BACKGROUND OF THE INVENTION

1. Field of the Invention

The present invention relates to a sucker rod pump for pumping fluids, such as hydrocarbons, from an underground formation to the earth's surface, and more particularly, but not by way of limitation, to an improved downhole pump assembly for pumping fluids while minimizing the conditions of "gas lock" and "gas pound."

2. Description of Related Art

Sucker rod pumps are often used when the natural pressure of an oil and gas formation is not sufficient to lift the oil to the surface of the earth. Sucker rod pumps operate by admitting fluid from the formation into a tubing and then lifting the fluid to the surface. To accomplish this, the sucker rod pump contains, among others, four elements:

(1) a pump or working barrel, (2) a plunger which travels in an up and down motion inside the pump barrel, (3) a standing valve positioned near the lower end of the pump barrel and (4) a traveling valve that is attached to and travels with the plunger.

A chamber is formed inside the pump barrel between the standing valve and the traveling valve. The standing valve allows fluid to flow into the chamber but does not allow fluid to flow out of the chamber. The traveling valve allows fluid to flow out of the chamber, but not into the chamber.

When the fluid that the sucker rod pump is pumping is substantially all liquids, the plunger is mechanically made to move up and down in a reciprocating motion. On the upstroke of a pumping cycle, where the plunger is moved upward, the hydrostatic pressure of the fluid above the traveling valve causes the traveling valve to close. The upward motion of the plunger also causes a negative fluid pressure to develop inside the chamber thereby causing the standing valve to open and to admit fluid from the formation into the chamber.

At the end of the upstroke, the chamber is filled with liquid from the formation. When the plunger begins the downstroke, the pressure in the chamber becomes positive which causes the standing valve to close. Because liquids are substantially incompressible, the pressure in the chamber rapidly increases to a pressure greater than the fluid column pressure above the traveling valve. When the fluid pressure in the chamber becomes greater than the fluid column pressure above the traveling valve, the traveling valve opens and fluid passes by the traveling valve where it is able to be lifted by the sucker rod pump on the upstroke.

When the fluid being pumped by the sucker rod pump is a mixture of gas and liquid, problems may be encountered. During the downstroke, the standing valve closes normally as the plunger compresses the gas and liquid in the chamber. However, the traveling valve does not open until the chamber pressure becomes greater than the hydrostatic pressure above the traveling valve. If the fluid contains a significant amount of gas, the traveling valve may not open at all, even as the plunger reaches the bottom of the downstroke. This condition results in a "gas lock." When the plunger compresses the gas and collides with the liquid, the collision generates a shock wave and is referred to as "gas pound." The shock wave causes the traveling valve to open quickly and this can cause damage to the traveling valve and to the tubing in the well.

To this end, a need exists for an improved sucker rod pump that prevents the formation of gas lock and gas pound. It is to such an improved sucker rod pump that the present invention is directed.

DETAILED DESCRIPTION OF THE INVENTION

Figure 1:
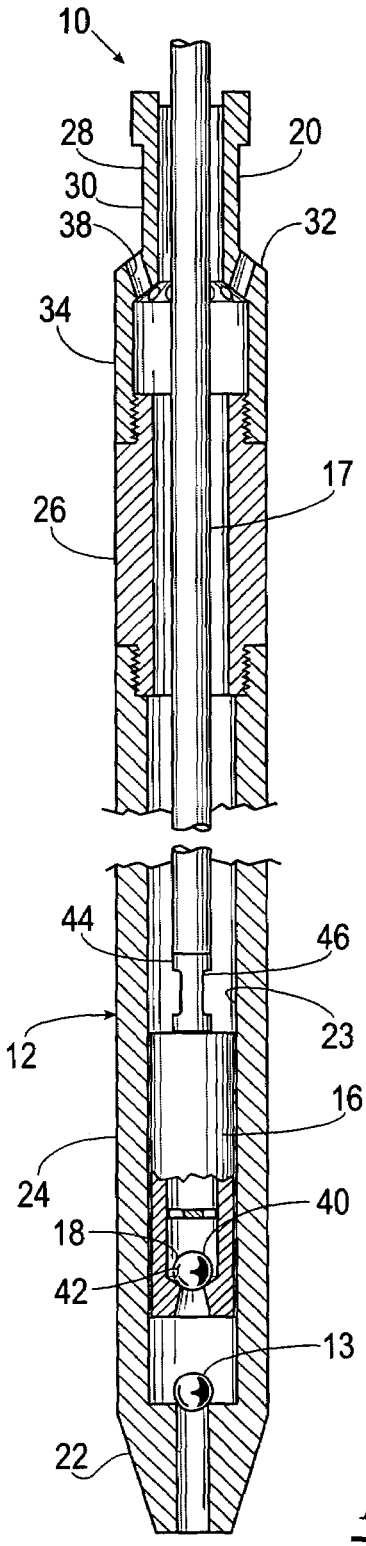
Prior Art Fig. 1
FIG. 1 is a partial cross-sectional, elevational view of a prior art downhole pump assembly.

Referring now to the drawings, and most particularly to FIG. 1, a prior art downhole pump assembly 10 is shown. The downhole pump assembly 10 is secured in a tubing (not shown) and used with a pump jack unit (not shown) and a sucker rod string (not shown) for elevating fluids, such as hydrocarbons, to the earth's surface. The downhole pump assembly 10 includes a housing 12, a standing valve 13, a plunger 16, a pull rod 17, and a traveling valve 18. The housing 12 is characterized as having an upper end 20, a lower end 22, and a chamber 23 extending from the upper end 20 to the lower end 22. The housing 12 includes a pump barrel 24, an adapter member 26, and a rod guide 28. The pump barrel 24 supports the standing valve 13 in a lower end thereof. The standing valve 13 is illustrated as being a conventional ball check valve. The adapter member 26 is connected to an upper end of the barrel 24, while the rod guide 28 is in turn connected to an upper end of the adapter member 26.

The rod guide 28 has an upper portion 30, an intermediate portion 32, and a lower portion 34. The upper portion 30 of the rod guide 28 has a reduced inner diameter relative to the lower portion 34 so that the pull rod 17 remains in a substantially vertical orientation as the pull rod 17 is caused to move in an up and down motion whereby the plunger 16 is caused to travel substantially along a longitudinal axis of the pump barrel 24. The intermediate portion 32 of the rod guide 28 is provided with a plurality of circumferentially spaced, fluid discharge ports 38. The fluid discharge ports 38 permit fluid to be discharged into the tubing while bypassing the upper portion 30 of the rod guide 28.

The plunger 16 is disposed in the pump barrel 24 and is adapted for reciprocating movement through pump barrel 24. The traveling valve 18 is located in a lower end of the plunger 16 to permit one way flow of fluid into the plunger 16. The traveling valve 18 is shown to be a ball check valve 40 and a seat 42. The plunger 16 is connected to the pull rod 17 by a plunger adapter 44 which is in fluid communication with the plunger 16 and is provided with a plurality of openings 46 to permit fluid to travel from the plunger 16 and into a portion of the chamber 23 of the housing 12 located above the plunger 16.

As stated above, on the upstroke of a pumping cycle, the plunger 16 is moved in an upward direction. The hydrostatic pressure of the fluid above the traveling valve 18 causes the traveling valve 18 to close. The upward motion of the plunger 16 further causes a negative pressure to develop inside the chamber 23 of the housing 12 below the plunger 16 thereby causing the standing valve 13 to open and admit fluid from the formation into the chamber 23.

At the end of the upstroke, the portion of the chamber 23, the traveling valve 18, and the standing valve 13 is filled with liquid from the formation. When the plunger 16 begins the downstroke, the pressure in the chamber 23 becomes positive which causes the standing valve 13 to close. Because liquids are substantially incompressible, the pressure in the chamber 23 rapidly increases to a pressure greater than the pressure above the traveling valve 18. When the fluid pressure in the chamber 23 becomes greater than the pressure above the traveling valve 18, the traveling valve 18 opens and fluid passes through the traveling valve 18 where it is able to be lifted by the plunger 16 on the subsequent upstroke.

As further stated above, when the fluid being pumped by the downhole pump assembly 10 is a mixture of gas and liquid, problems may be encountered. That is, because the traveling valve 18 will not open until the pressure below the traveling valve 18 becomes greater than the hydrostatic pressure above the traveling valve 18, if the fluid contains a significant amount of gas, the traveling valve 18 may not open at all, resulting in the condition known as "gas lock". In another instance, the plunger 16 may compress the gas thereby resulting in the plunger 16 colliding with the liquid. The collision between the plunger 16 and the liquid generates a shockwave and is referred to as "gas pound." The shockwave causes the traveling valve 18 to open quickly which can result in damage to the traveling valve 18 and to the other components of the downhole pump assembly 10.

Figure 2:
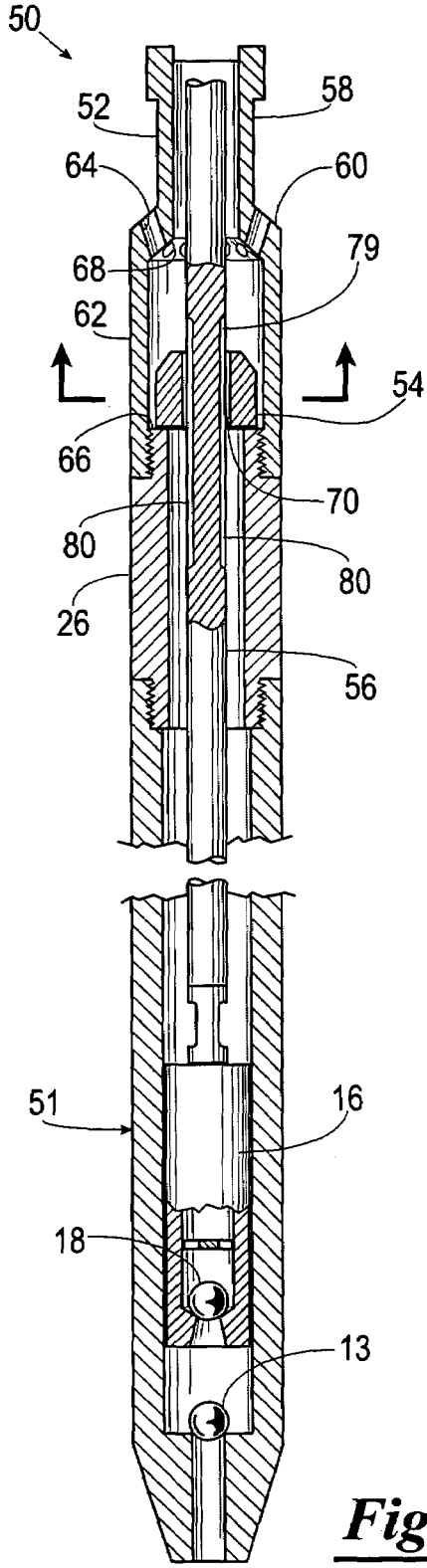
FIG. 2 is a partial cross-sectional, elevational view of a downhole pump assembly constructed in accordance with the present invention.

Referring now to FIG. 2, a downhole pump assembly 50 constructed in accordance with the present invention is shown. Because the downhole pump assembly 50 is similar construction to the downhole pump assembly 10, only those components that are modified will be described in detail below and like numerals will be used throughout to describe like components. The downhole pump assembly 50 includes a housing 51, which includes a rod guide 52, a standing valve 13, a plunger 16, a traveling valve 18, a sliding valve 54 positioned in the rod guide 52, and a pull rod 56 which extends through the rod guide 52 and the sliding valve 54 and is connected to the plunger 16.

The rod guide 52 has an upper portion 58, an intermediate portion 60, and a lower portion 62. The upper portion 58 of the rod guide 52 has a reduced inner diameter relative to the lower portion 62 so that the pull rod 56 remains in a substantially vertical orientation as the pull rod 56 is caused to move in an up and down motion whereby the plunger 16 is caused to reciprocate substantially along a longitudinal axis of the housing 51. The intermediate portion 60 of the rod guide 52 is provided with a plurality of circumferentially spaced, fluid discharge ports 64. The discharge ports 64 permit fluid to bypass the upper portion 58 of the rod guide 52 and flow into the tubing (not shown).

The rod guide 52 is modified relative to the rod guide 28 shown in FIG. 1. In particular, the length and the inner diameter of the lower portion 62 of the rod guide 52 are increased relative to the rod guide 28 to accommodate the sliding valve 54 in an amount sufficient so that fluid flow is not substantially restricted around the sliding valve 54. By way of example, for a rod guide typically used with a 1.5 inch to 1.75 inch working barrel, the length of the lower portion 62 of the rod guide 52 may be increased approximately one inch to accommodate the sliding valve 54, while the inner diameter of the lower portion 62 of the rod guide 52 may be increased to approximately 1.5 inches from 1.485 inches. The outer diameter of the lower portion 62 of the rod guide 52 may also be increased an increment equal to the increase of the inner diameter to increase the mechanical strength of the rod guide 52. However, it has been found that if such an increase of the outer diameter is not made, the mechanical integrity of the rod guide 52 is not significantly affected. It will be appreciated that when used with working barrels of varying dimensions (e.g., 1.0625 inches and 2.0 inches), the dimensions of the rod guide 52 are altered accordingly.

The lower portion 62 of the rod guide 52 is connected to the upper end of the adapter member 26. Because the upper end of the adapter member 26 is received by the lower portion 62 of the rod guide 52, the upper end of the adapter member 26 defines a lower internal shoulder 66 with which the sliding valve 54 will engage when the sliding valve 54 is in a lowered position. An upper internal shoulder 68 is defined by the intermediate portion 60 of the rod guide 52. As shown in FIG. 2, the intermediate portion 60 of the rod guide 52 has a tapered configuration. It will be appreciated, however, that the intermediate portion 60 of the rod guide 52 may be formed so as to extend in a perpendicular relationship to the lower portion 62 and the upper portion 58.

Figure 3:
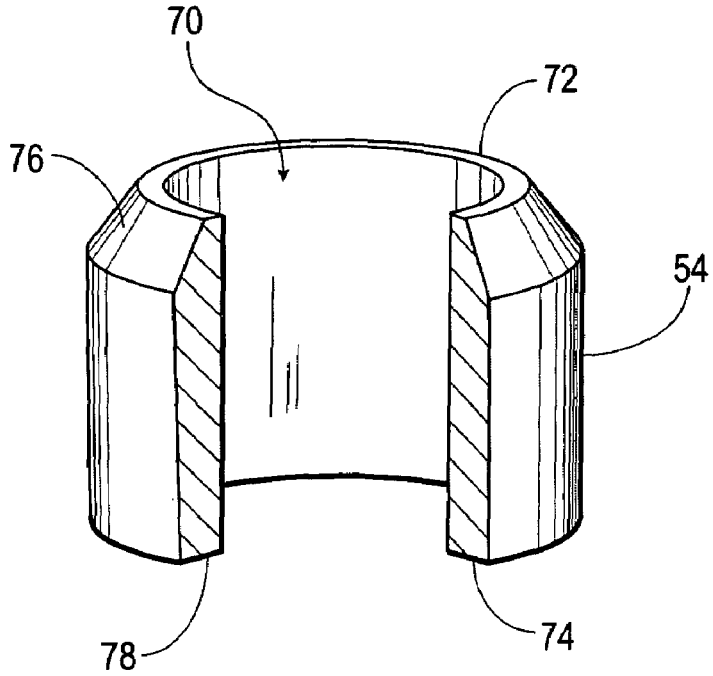
FIG. 3 is a partially cut away, perspective view of a body member utilized in the downhole pump assembly of FIG. 2.
Figure 5:
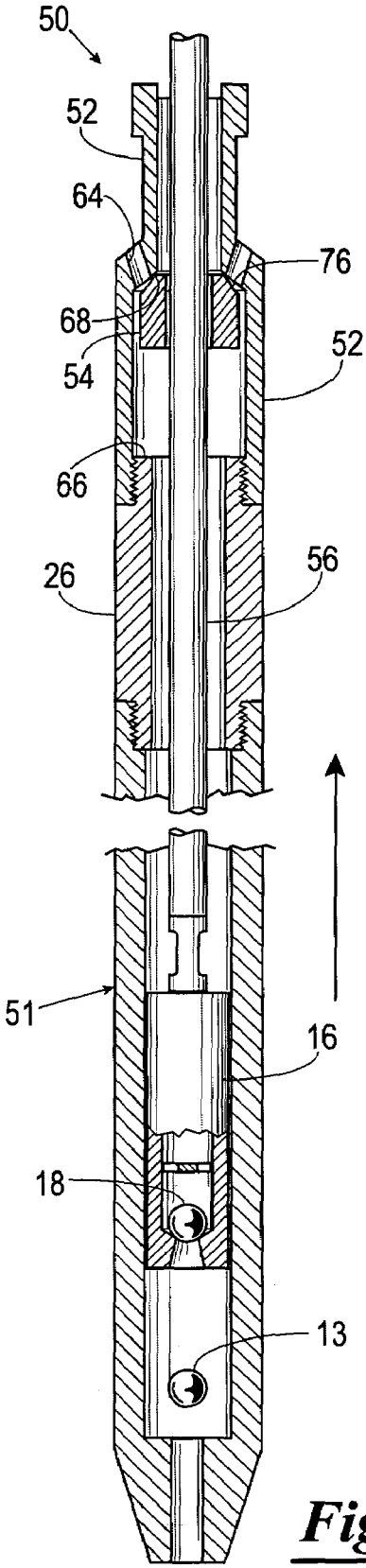
FIG. 5 is a partial cross-sectional view of the downhole pump assembly of FIG. 2 shown in an upstroke position.

As illustrated in FIGS. 2 and 3, the sliding valve 54 has a substantially cylindrical configuration with a vertical passage 70. The vertical passage 70 is sized as to slidingly receive the pull rod 56. The sliding valve 54 has an upper end 72 and a lower end 74. The upper end 72 of the sliding valve 54 is shaped to engage the upper internal shoulder 68 while permitting fluid to pass through the ports 64 of the rod guide 52. More specifically, the upper end 72 of the sliding valve 54 is provided with a chamfered surface 76. As best illustrated in FIG. 5, the chamfered surface 76 must be formed at an angle greater than the angle of the upper internal shoulder 68 of the rod guide 52 so as to permit fluid to pass around the sliding valve 54 and through the fluid discharge ports 64 when the sliding valve 54 is in an up position and engaged with the upper internal shoulder 68 of the rod guide 52.

The lower end 74 of the sliding valve 54 has a ring shaped surface 78 that is dimensioned so that an outer portion of the ring shaped surface 78 engages the lower internal shoulder 66 when the sliding valve is in a downward position and an inner portion of the ring shaped surface 78 extends inwardly beyond the lower internal shoulder 66.

By way of example, for use with a rod guide having a lower portion with an inner diameter of 1.5 inches and a pull rod with a diameter of 0.875 inches, the sliding valve 54 has an outer diameter of approximately 1.35 inches and an inner diameter of approximately 0.88 inches so that the pull rod 56 slides easily through the vertical passage 70 of the sliding valve 54 while providing a sufficient fluid seal between the sliding valve 54 and the pull rod 56 and accounting for thermal expansion of the pull rod 56 which might prevent the pull rod 56 from sliding freely through the vertical passage 70 of the sliding valve 54. The upper end 72 and the lower end 74 are preferably smooth and flat with the chamfered surface 76 at approximately 45° for about 0.16 inches, thereby leaving the upper end 72 with a thickness of approximately 0.10 inches. The sliding valve 54 may be provided with a length of approximately one inch. However, it should be appreciated that the length of the sliding valve 54 may be varied depending on the dimensions of the rod guide 52.

Figure 4:
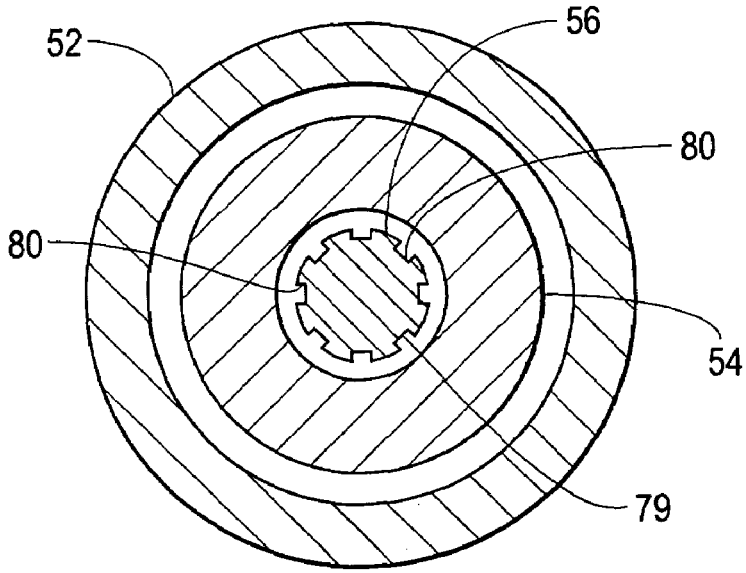
FIG. 4 is a sectional view taken along line 4—4 of FIG. 2.

Referring now to FIGS. 2 and 4, a portion of the pull rod 56 is provided with a portion of reduced diameter 79. More specifically, the portion of reduced diameter 79 is defined by a plurality of vertical grooves or flutes 80. The vertical grooves 80 are configured to extend through the sliding valve 54 near the end of the downward movement of the plunger 16 to increase the flow area between the pull rod 56 and the sliding valve 54 so as to cause the pressure above the sliding valve 54 and the pressure below the sliding valve 54 to be substantially equalized.

As best shown in FIG. 4, the pull rod 56 is shown to be provided with eight, equally spaced vertical grooves 80. Each vertical groove is approximately 0.17 inches wide and 0.06 inches deep. Additionally, each vertical groove 80 is formed to be approximately twelve to twenty inches long and preferably approximately eighteen inches long starting from approximately seven inches from the top of the pull rod 56. It will be appreciated that the dimensions or spacing of the vertical grooves 80 may be varied depending on the dimensions of the pull rod 56. Additionally, the position of the vertical grooves 80 within the pull rod 56 may be varied depending on stroke length, stroke speed, and plunger position. In the end, it is desirable for the vertical grooves 80 to be formed in the pull rod 56 such that the vertical grooves 80 travel beyond the lower end of the sliding valve 54 for approximately 0.5 seconds to approximately 1 second. It has been found that this time period is sufficient to allow pressure above and below the sliding valve 54 to equalize on the downstroke, while permitting a seal to be formed between the sliding valve 54 and the pull rod 56 soon after the commencement of the upstroke. It will also be appreciated that the number of the vertical grooves 80 may be varied. However, care should be taken so as not to create unwarranted stress risers in the pull rod 56 which may degrade the mechanical integrity of the pull rod 56. To aid in maintaining the mechanical integrity of the pull rod 56, the upper and lower ends of the vertical grooves 80 are sloped or curved rather than squared.

Operation

Figure 6:
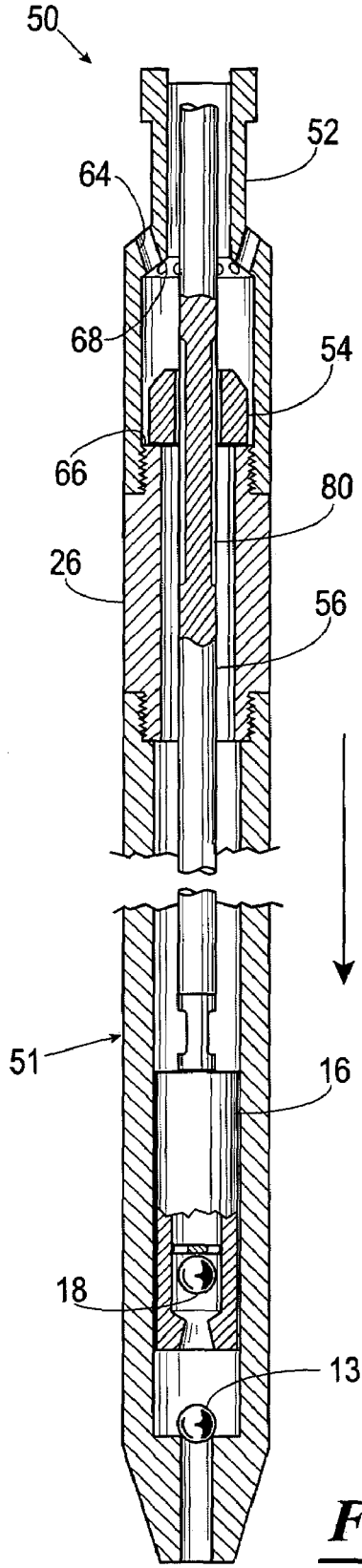
FIG. 6 is a partial cross-sectional view of the downhole pump assembly of FIG. 2 shown in a downstroke position.

Referring to FIGS. 5 and 6, on the upstroke of a pumping cycle, the plunger 16 is moved in an upward direction as indicated by the arrow in FIG. 5. The hydrostatic pressure of the fluid above the traveling valve 18 causes the traveling valve 18 to close and thereby cause the fluid located above the traveling valve 18 to be lifted toward the surface. The lifting of the fluid by the plunger 16 causes the sliding valve 54 to be moved in an upward direction into engagement with the upper internal shoulder 68 of the rod guide 52 so that fluid is allowed to flow past the sliding valve 54 and through the fluid discharge ports 64 of the rod guide 52.

When the plunger 16 begins the downstroke, the hydrostatic pressure of the fluid above the sliding valve 54 causes the sliding valve 54 to move in a downward direction into engagement with the lower internal shoulder 66 (FIG. 6) where the sliding valve 54 functions to restrict the flow of fluid into the space between the sliding valve 54 and the traveling valve 18. With the flow of fluid restricted, the pressure above the traveling valve 18 is less than the pressure below the traveling valve 18, and thus the traveling valve 18 opens at the commencement of the downstroke thereby preventing the conditions of "gas lock" and "gas pound."

As shown in FIG. 6, near the end of the downstroke, the vertical grooves 80 of the pull rod 56 pass through the sliding valve 54 thereby increasing the flow area between the sliding valve 54 and the pull rod 56. The increased flow area causes the pressure above the sliding valve 54 and the pressure below the sliding valve 54 to be substantially equalized so that the sliding valve 54 is caused to be moved in the upward direction at the commencement of the subsequent upstroke. It should be appreciated that if the pressure above and below the sliding valve 54 is not equalized, use of the sliding valve 54 will merely transfer the gas pound problem to the upstroke. That is, the sliding valve 54 may not immediately unseat from the lower internal shoulder 66 and move upwardly because the space between the traveling valve 18 and the sliding valve 54 may not be filled completely with fluid. Consequently, the plunger 16 may travel a distance before the pressure builds to overcome the hydrostatic pressure applied to the sliding valve 54 and cause the sliding valve 54 to move in the upward direction into engagement with the upper internal shoulder 68. When the sliding valve 54 does move upwardly, it may do so suddenly thereby causing a shock to the downhole pump assembly 50. This potential for gas pound on the upstroke is prevented by allowing the pressure above the sliding valve 54 and the pressure below the sliding valve 54 to substantially equalize prior to the upstroke being initiated. This is accomplished by increasing the flow area between the sliding valve 54 and the pull rod 56 near the bottom of the downstroke.

From the above description, it is clear that the present invention is well adapted to carry out the objects and to attain the advantages mentioned herein as well as those inherent in the invention. While presently preferred embodiment of the invention has been described for purposes of this disclosure, it will be understood that numerous changes may be made which will readily suggest themselves to those skilled in the art and which are accomplished within the spirit of the invention disclosed and claimed.

What is claimed:

1. A downhole pump assembly, comprising:

a housing having a longitudinal axis extending from an upper end of the housing to a lower end of the housing and a chamber extending through the housing from the upper end to the lower end, the housing having an upper internal shoulder and a lower internal shoulder, the lower internal shoulder having an upper surface substantially normal to the longitudinal axis of the housing, the upper and lower internal shoulders arranged in an opposing relationship;

a standing valve located in the housing to permit one way flow of fluid into the chamber of the housing;

a plunger disposed in the chamber of the housing above the standing valve and below the upper and lower internal shoulders thereof and adapted for reciprocating movement through at least a portion of the chamber of the housing;

a traveling valve located in the plunger to permit one way flow of fluid into the plunger;

a pull rod having one end connected to the plunger and an opposite end connectable to a sucker rod string to affect reciprocating movement of the plunger; and a sliding valve positioned in the chamber of the housing between the upper internal shoulder and the lower internal shoulder, the sliding valve moved to an upward position into engagement with the upper internal shoulder in response to upward movement of the plunger, in the upward position the sliding valve permitting fluid to flow around the sliding valve and upwardly through the chamber of the housing, the sliding valve moved to a downward position into engagement with the upper surface of the lower internal shoulder of the housing in response to downward movement of the plunger, in the downward position the sliding valve restricting the downward flow of fluid through the chamber of the housing sufficiently so that the pressure above the traveling valve is less than the pressure below the traveling valve during the downward movement of the plunger thereby causing the traveling valve to open, wherein the pull rod is provided with a portion of reduced diameter extending through the sliding valve near the end of the downward movement of the plunger thereby increasing the flow area between the pull rod and the sliding valve to permit the pressure above the sliding valve and the pressure below the sliding valve to substantially equalize prior to commencement of upward movement of the plunger so that the sliding valve is caused to move in the upward direction upon upward movement of the plunger.

2. The downhole pump assembly of claim 1 wherein the housing includes a rod guide provided with a plurality of circumferentially spaced, fluid discharge ports, the sliding valve being positioned in the rod guide, and wherein an upper end of the sliding valve is chamfered an amount sufficient so as not to substantially restrict the flow of fluid through the fluid discharge ports when the sliding valve is in the upward position.

3. The downhole pump assembly of claim 1 wherein the sliding valve has a substantially cylindrical shape.

4. The downhole pump assembly of claim 3 wherein the housing includes a rod guide provided with a plurality of circumferentially spaced, fluid discharge ports, the sliding valve being positioned in the rod guide, and wherein an upper end of the sliding valve is chamfered an amount sufficient so as not to substantially restrict the flow of fluid through the fluid discharge ports when the sliding valve is in the upward position.

5. The downhole pump assembly of claim 1 wherein the portion of reduced diameter of the pull rod has a length such that during downward movement of the plunger the portion of reduced diameter travels beyond a lower end of the sliding valve for a period of time ranging from approximately 0.5 seconds to approximately 1.0 second.

6. The downhole pump assembly of claim 1 wherein the portion of reduced diameter of the pull rod has a length ranging from about twelve inches to about twenty inches.

7. A downhole pump assembly, comprising:

a housing having a longitudinal axis extending from an upper end of the housing to a lower end of the housing and a chamber extending through the housing from the upper end to the lower end, the housing having an upper internal shoulder and a lower internal shoulder, the lower internal shoulder having an upper surface substantially normal to the longitudinal axis of the housing, the upper and lower internal shoulders arranged in an opposing relationship;

a standing valve located in the housing to permit one way flow of fluid into the chamber of the housing;

a plunger disposed in the chamber of the housing above the standing valve and below the upper and lower internal shoulders thereof and adapted for reciprocating movement through at least a portion of the chamber of the housing;

a traveling valve located in the plunger to permit one way flow of fluid into the plunger;

a pull rod having one end connected to the plunger and an opposite end connectable to a sucker rod string to affect reciprocating movement of the plunger; and a sliding valve having a vertical passage through which the pull rod is slidingly received, the sliding valve positioned in the chamber of the housing between the upper internal shoulder and the lower internal shoulder, the sliding valve moved to an upward position into engagement with the upper internal shoulder in response to upward movement of the plunger, in the upward position the sliding valve permitting fluid to flow around the sliding valve and upwardly through the chamber of the housing, the sliding valve moved to a downward position into engagement with the upper surface the lower internal shoulder of the housing in response to downward movement of the plunger, in the downward position the sliding valve restricting the downward flow of fluid through the chamber of the housing so that the pressure above the traveling valve is less than the pressure below the traveling valve during the downward movement of the plunger to cause the traveling valve to open, wherein a portion of the pull rod is provided with a plurality of vertical grooves configured to extend through the sliding valve near the end of the downward movement of the plunger to increase the flow area between the pull rod and the sliding valve and thereby cause the pressure above the sliding valve and the pressure below the sliding valve to be substantially equalized prior to commencement of upward movement of the plunger so that the sliding valve is caused to move in the upward direction upon upward movement of the plunger.

8. The downhole pump assembly of claim 7 wherein the housing includes a rod guide provided with a plurality of circumferentially spaced, fluid discharge ports, the sliding valve being positioned in the rod guide, and wherein an upper end of the sliding valve is chamfered an amount sufficient so as not to substantially restrict the flow of fluid through the fluid discharge ports when the sliding valve is in the upward position.

9. The downhole pump assembly of claim 7 wherein the sliding valve has a substantially cylindrical shape.

10. The downhole pump assembly of claim 9 wherein the housing includes a rod guide provided with a plurality of circumferentially spaced, fluid discharge ports, the sliding valve being positioned in the rod guide, and wherein an upper end of the sliding valve is chamfered an amount sufficient so as not to substantially restrict the flow of fluid through the fluid discharge ports when the sliding valve is in the upward position.

11. The downhole pump assembly of claim 7 wherein the vertical grooves of the pull rod are dimensioned such that during downward movement of the plunger the vertical grooves travel beyond a lower end of the sliding valve for a period of time ranging from approximately 0.5 seconds to approximately 1.0 second.

12. The downhole pump assembly of claim 7 wherein each of the vertical grooves of the pull rod has a length ranging from about twelve inches to about twenty inches.

* * * * *